US008678835B2

(12) United States Patent
Takahashi et al.

(10) Patent No.: US 8,678,835 B2
(45) **Date of Patent: *Mar. 25, 2014**

(54) ROTARY CONNECTOR

(75) Inventors: Seishi Takahashi, Miyagi-ken (JP); Hiroyuki Sato, Miyagi-ken (JP); Yasuhisa Osumi, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 72 days.

This patent is subject to a terminal disclaimer.

(21) Appl. No.: 13/418,014

(22) Filed: Mar. 12, 2012

(65) Prior Publication Data

US 2012/0238112 A1 Sep. 20, 2012

(30) Foreign Application Priority Data

Mar. 14, 2011 (JP) ..... 2011-055335

(51) Int. Cl.
*H01R 39/00* (2006.01)

(52) U.S. Cl.
USPC ..... 439/13; 439/164

(58) Field of Classification Search
USPC ..... 439/13, 15, 17–24, 77, 164
See application file for complete search history.

(56) References Cited

U.S. PATENT DOCUMENTS

| | | | | |
|---|---|---|---|---|
| 4,464,007 | A | 8/1984 | Parmer | |
| 5,286,218 | A | 2/1994 | Sakurai et al. | |
| 5,674,082 | A * | 10/1997 | Okuhara et al. | 439/164 |
| 6,371,779 | B2 * | 4/2002 | Matsumoto | 439/164 |
| 6,390,838 | B1 * | 5/2002 | Kawamura | 439/164 |
| 6,471,529 | B2 * | 10/2002 | Oishi | 439/164 |
| 6,641,404 | B2 * | 11/2003 | Matsuzaki et al. | 439/15 |
| 6,764,326 | B2 * | 7/2004 | Matsumoto et al. | 439/164 |
| 7,175,454 | B2 * | 2/2007 | Araki et al. | 439/164 |
| 7,445,451 | B2 * | 11/2008 | Tanaka et al. | 439/15 |
| 7,811,108 | B2 * | 10/2010 | Oishi et al. | 439/164 |
| 2013/0237099 | A1 * | 9/2013 | Takahashi et al. | 439/697 |

FOREIGN PATENT DOCUMENTS

| | | |
|---|---|---|
| EP | 1378964 A2 | 1/2004 |
| GB | 2346743 A | 8/2000 |
| JP | 11-097088 | 4/1999 |

OTHER PUBLICATIONS

Extended European Search Report issued in corresponding European Patent Application No. 12157488.3, mailed May 18, 2012.

* cited by examiner

*Primary Examiner* — Thanh Tam Le
(74) *Attorney, Agent, or Firm* — Brinks Gilson & Lione

(57) ABSTRACT

After a lead block, where a required number of pin terminals are fitted to and assembled with an insulating support member, is connected to an end portion of a flat cable, the lead block is assembled with a lower connector holder of a rotary connector. The lower connector holder includes lower protruding portions of a lower cover and an outer cylindrical portion that are snap-fitted to each other. The lower protruding portion includes a receiving recess and the lower protruding portion includes a holding wall portion. Leading end portions of pin terminals are inserted into insertion holes of the holding wall portion, so that the lead block is assembled. While stopper portions of the pin terminals are interposed between the holding wall portion and the outer wall of the support member, the support member is positioned and held in the receiving recess.

6 Claims, 5 Drawing Sheets

ROTARY CONNECTOR

CLAIM OF PRIORITY

This application claims benefit of Japanese Patent Application No. 2011-055335 filed on Mar. 14, 2011, which is hereby incorporated by reference in its entirety.

BACKGROUND

1. Field of the Disclosure

The present disclosure relates to a rotary connector, and more particularly, to a rotary connector including lead blocks that make a plurality of pin terminals connected to a flat cable be arranged parallel to each other and hold the pin terminals.

2. Description of the Related Art

In a rotary connector that is used as the electrical connection means of an air bag system assembled into the steering device of an automobile and the like, an annular space is formed between a movable-side housing and a stationary-side housing connected so as to be rotatable relative to each other and a flat cable is received in the annular space while being wound. Connecting members (lead blocks), which are electrically connected to the outside, are connected to both end portions of the flat cable, respectively. The lead block, which is connected to one end portion of the flat cable, is mounted on a movable-side housing of the rotary connector, which is rotated integrally with a steering wheel, and is connected to an external connector that is led from an air bag system, a horn circuit, and the like provided on the steering wheel. Further, the lead block, which is connected to the other end portion of the flat cable, is mounted on a stationary-side housing of the rotary connector, and is connected to an external connector that is led from an electrical device provided on a vehicle main body.

In the rotary connector in the related art having the schematic structure, the connecting members are formed by covering a plurality of parallel conductors except for holes for welding with an insulating material. Accordingly, the plurality of parallel conductors are exposed to the outside at both end portions of the flat cable. Further, the connecting members are superimposed on one surface of the flat cable so that conductors of the flat cable cross the conductors of the connecting members. Then, the conductors of the connecting members, which are exposed to welding-connection holes, are connected to the conductors of the flat cable by welding (for example, see Japanese Unexamined Patent Application Publication No. 11-97088).

Since the lead block used for the rotary connector in the related art is formed by covering the conductors except for holes for welding with an insulating material, the lead block need to be manufactured by insert molding. Accordingly, since the shape of a mold used to manufacture the connecting member becomes complicated, the manufacturing costs of the lead block are increased. For this reason, it is difficult to reduce the costs of the rotary connector.

SUMMARY

There is provided a rotary connector including: a movable-side housing and a stationary-side housing that are connected so as to be rotatable relative to each other; an annular space that is formed between the movable-side housing and the stationary-side housing; a flat cable that is received in the annular space while being wound and is formed by covering a plurality of belt-like conductors, which are arranged parallel to each other, except for connecting portions with a pair of insulating films; and a lead block that is connected to the connecting portions of the flat cable, include a plurality of pin terminals arranged parallel to each other, and are electrically connected to the outside. The flat cable and the lead block overlap each other so that the plurality of pin terminals cross the plurality of belt-like conductors. The plurality of pin terminals of the lead block are fitted to an insulating support member and held so that leading end portions of the plurality of pin terminals protrude to the outside, and include joint portions connected to the connecting portions of the flat cable.

According to this structure, since the lead block does not need to be formed using a complicated mold by insert molding and it is possible to form the lead block simply by fitting the plurality of pin terminals to the insulating support member and holding the plurality of pin terminals, it is possible to significantly reduce the costs of the lead block. Accordingly, it is possible to provide a rotary connector of which costs can be reduced.

DESCRIPTION OF THE EXEMPLARY EMBODIMENTS

Figure 1:
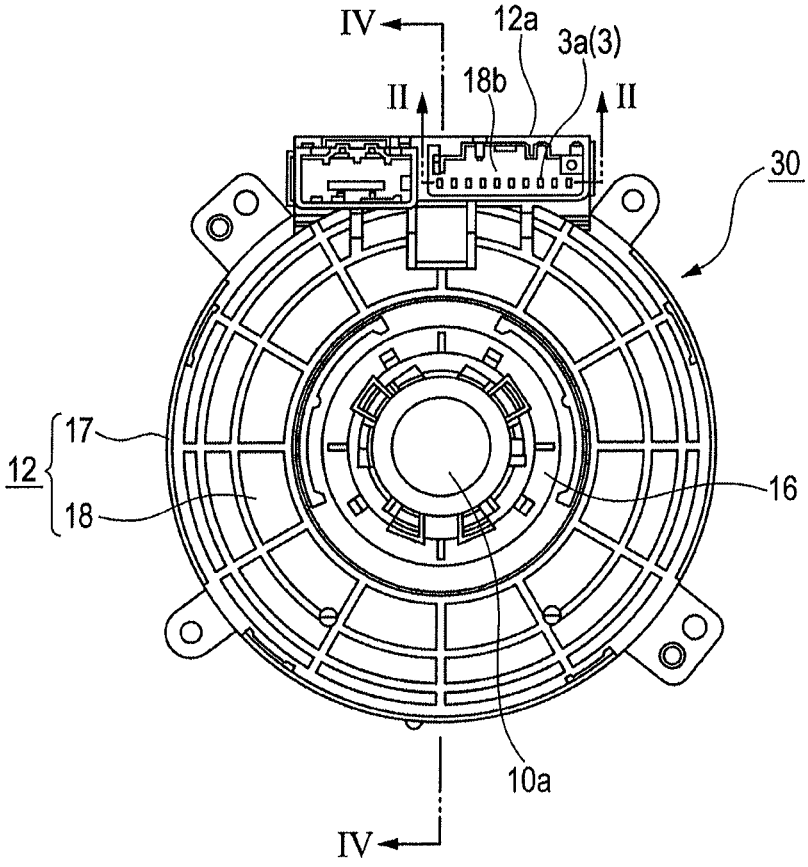
FIG. 1 is a bottom view of a rotary connector according to an embodiment of the invention.
Figure 4:
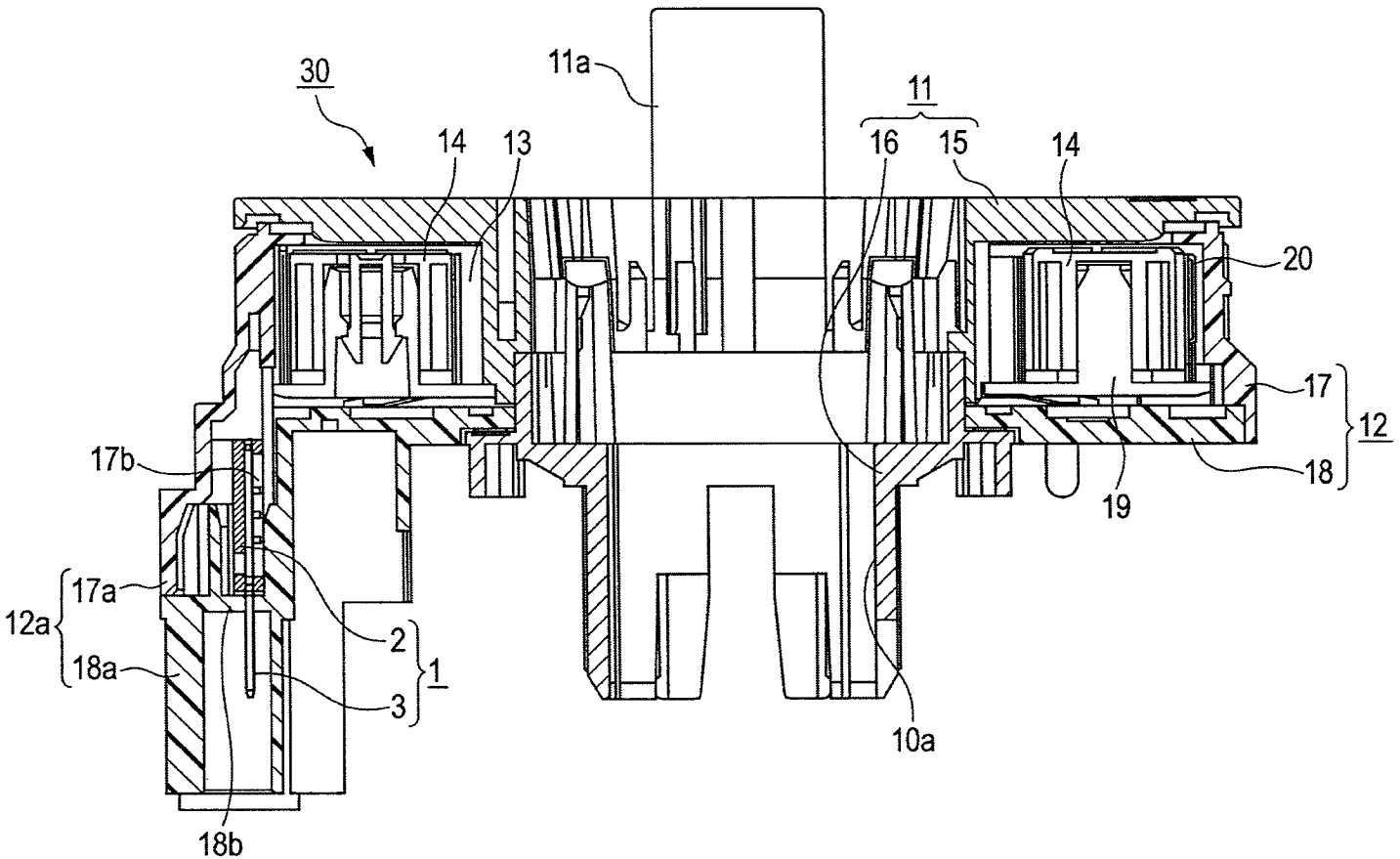
FIG. 4 is a cross-sectional view taken along a line IV-IV of FIG. 1.

An embodiment of the invention will be described below with reference to the drawings. As shown in FIGS. 1 and 4, a rotary connector 30 according to this embodiment connects a movable-side housing 11, which is rotated integrally with a steering wheel (not shown), with a stationary-side housing 12, which is provided on a steering column and the like, so that the movable-side housing 11 and the stationary-side housing 12 are rotatable relative to each other. The rotary connector 30 has a structure where a flat cable 20 is received in an annular space 13 formed between both the housings 11 and 12 while being wound. The rotary connector 30 is assembled within a steering device of an automobile and used as the electrical connection means of an air bag system or the like. Meanwhile, a steering shaft (not shown) is inserted into a center hole 10*a* of the rotary connector 30.

An upper rotor 15 and a lower rotor 16 are integrated with each other by snap fitting, so that the movable-side housing 11 is formed. A lead block (not shown) is assembled with an upper connector holder 11*a* that protrudes upward in FIG. 4. An outer cylindrical portion 17 as a second case body and a lower cover 18 as a first case body are integrated with each other by snap fitting, so that the stationary-side housing 12 is formed. A lead block 1 is assembled with a lower connector holder 12*a* that protrudes downward in FIG. 4. The annular space 13 is formed between both the housings 11 and 12, and the flat cable 20 is received in the annular space 13 so as to be capable of being wound and rewound. Further, a plurality of rollers 14, which guide the winding operation and the rewinding operation of the flat cable 20, and a roller holder 19, which holds the rollers 14 so as to allow the rollers 14 to be rotatable, are assembled in the annular space 13.

One end portion (outer end portion) of the flat cable 20 is connected to the lead block 1, and the lead block 1 is held by the lower connector holder 12*a* of the stationary-side housing 12. As shown in FIG. 4, the lower connector holder 12*a* is formed by the combination of a lower protruding portion 17*a* (second case body) of the outer cylindrical portion 17 (second case body) and a lower protruding portion 18*a* (first case body) of the lower cover 18 (first case body). The lead block 1 is adapted so that an external connector led from an electrical device provided on a vehicle main body is connected to the lead block 1. Further, the other end portion (inner end portion) of the flat cable 20 is connected to a lead block (not shown), and this lead block is held by the upper connector holder 11*a* of the movable-side housing 11. This lead block (not shown) is adapted so that an external connector led from an air bag system, a horn circuit, or the like provided on the steering wheel is connected to the lead block.

Figure 2:
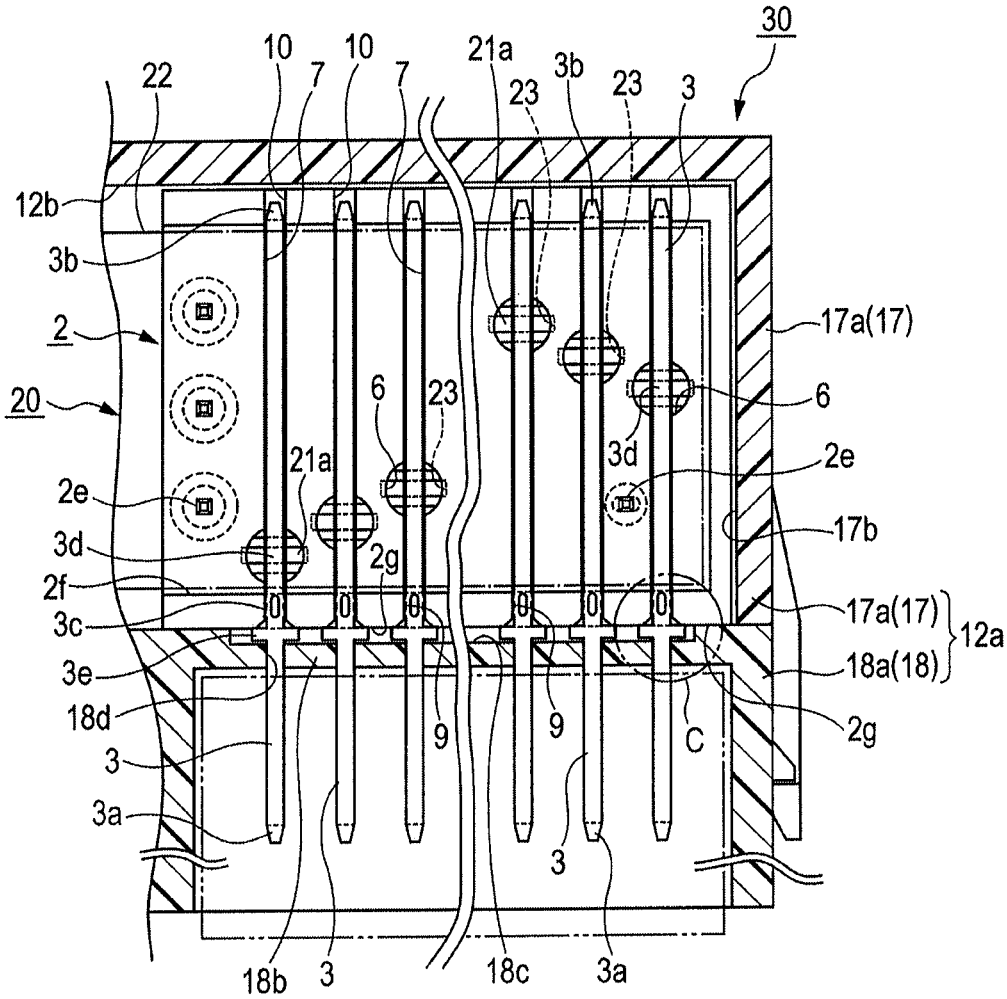
FIG. 2 is a view showing a part of a cross-sectional structure taken along a line II-II of FIG. 1.
Figure 6:
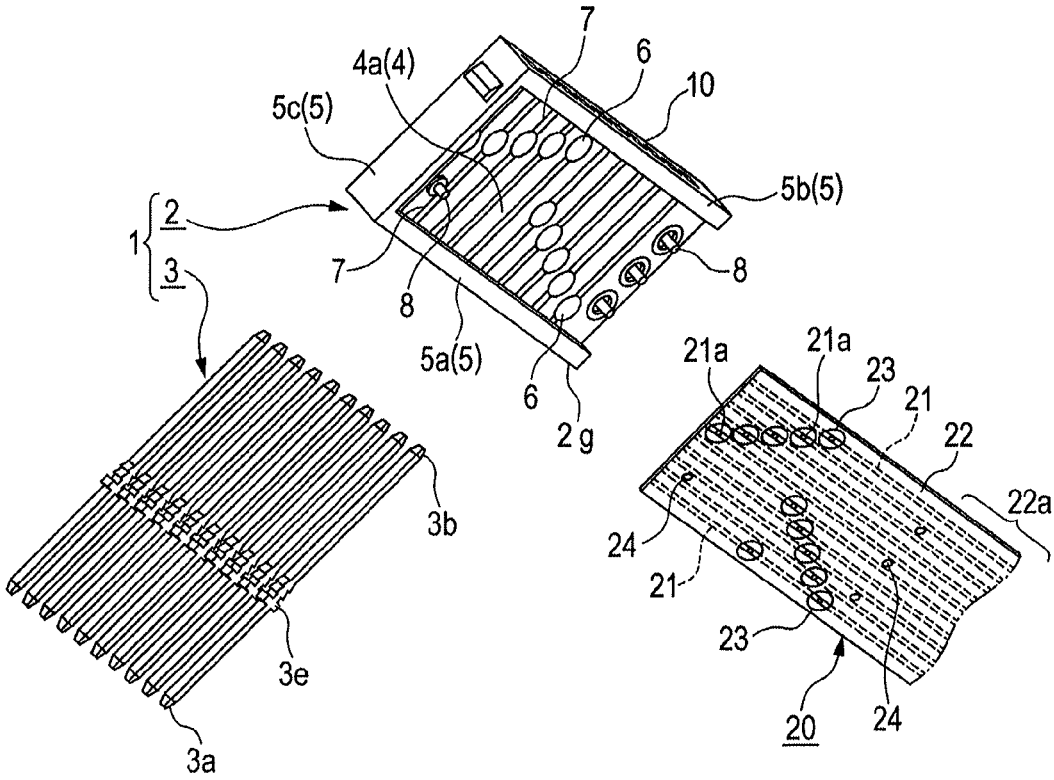
FIG. 6 is an exploded perspective view of the lead block and a flat cable shown in FIG. 2.

As shown in FIGS. 2 and 6, the flat cable 20 is a belt-like body that is formed by covering a plurality of belt-like conductors 21, which are arranged parallel to each other, with a pair of insulating films 22. At the insulating films 22 of the end portion of the flat cable 20, conductor exposure holes 23 through which a part (connecting portions 21*a*) of the respective belt-like conductors 21 are exposed to the outside are formed and through holes 24 into which positioning protrusions 8 formed at the lead block 1 are inserted are formed. A long portion 22*a*, which forms a portion of the flat cable 20 between both end portions of the flat cable 20, is received in the annular space 13 of the rotary connector 30 (FIG. 4). As the movable-side housing 11 is rotated, a winding operation or a rewinding operation is performed. Meanwhile, FIG. 6 is an exploded perspective view when seen from the back side of the plane of FIG. 2.

As shown in FIGS. 2 and 4, the lead block 1 includes a support member 2 that is formed of an insulating resin molding; and a plurality of pin terminals 3 that are arranged parallel to each other and fitted and fixed to the support member 2 so as to be held. Jetty portions 5 (5*a*, 5*b*, and 5*c*) are erected along three sides of a rectangular bottom plate portion 4 of the support member 2, that is, three sides of the support member 2 except for one side that is a portion through which the flat cable 20 extends outward. The flat cable 20 is disposed and superimposed on an inner surface portion 4*a* of the bottom plate portion 4 forming an inner area of the jetty portions 5 so that the respective belt-like conductors 21 of the flat cable 20 are orthogonal to the respective pin terminals 3 of the support member 2. Further, the connecting portions 21*a* of the belt-like conductors 21 are exposed to the conductor exposure hole (hole portions) 23 of the flat cable 20, and joint portions 3*d* of the pin terminals 3 cross above the conductor exposure holes 23. The connecting portions 21*a* and the joint portions 3*d*, which cross each other, are welded and connected to each other as described below. Meanwhile, one side of the support member 2 where the jetty portion 5 is not formed forms an open end portion 2*f* (see FIG. 2) that guides the long portion 22*a* of the flat cable 20 to the annular space 13. When the lead block 1 is assembled in the lower connector holder 12*a*, the open end portion 2*f* is adjacent to an opening 12*b* formed at the lower connector holder 12*a* of the stationary-side housing 12 (see FIG. 2).

Figure 5:
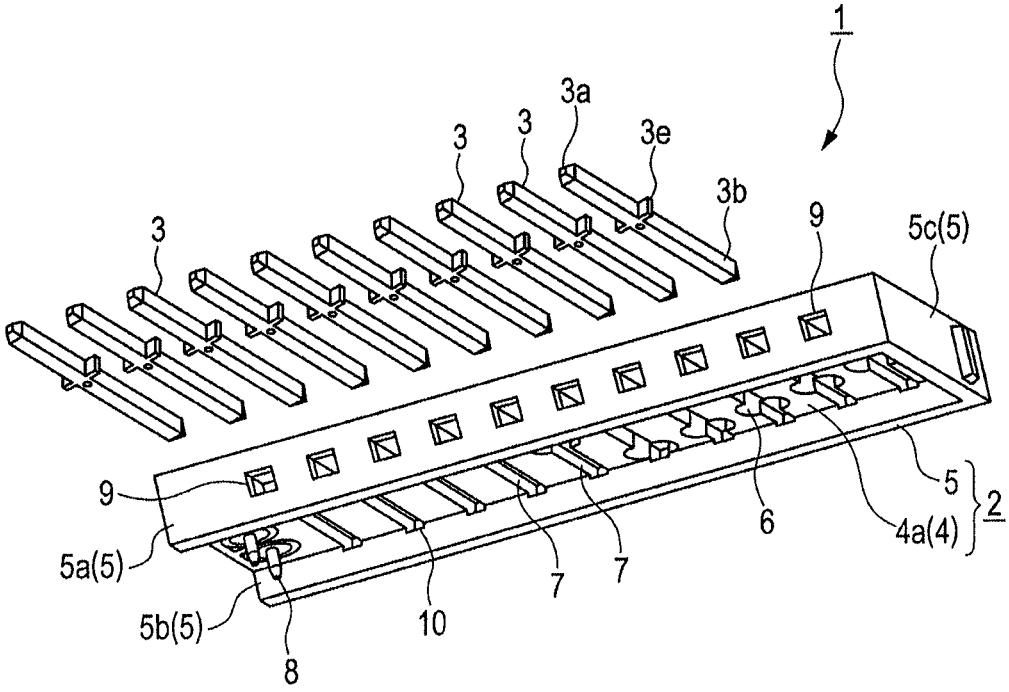
FIG. 5 is an exploded perspective view of a lead block shown in FIG. 2.

As shown in FIG. 2, a plurality of mounting hole portions 9 (first holding portions) are formed at one of two long jetty portions, which face each other, of the jetty portions 5 of the support member 2, that is, at the jetty portion 5*a*, which is disposed along one long side of the support member 2 positioned close to leading end portions 3*a* of the pin terminals 3 shown in FIG. 2, at regular intervals. When the respective pin terminals 3 are inserted and fitted into the mounting hole portions 9 from the leading end portions 3*a* thereof, these mounting hole portions 9 hold the respective pin terminals 3 so that the respective pin terminals 3 are fixed. Further, fitting portions 10 (second holding portions) into which base end portions 3*b* of the respective pin terminals 3 are fitted are formed at the jetty portion 5*b*, which is disposed along the other long side of the support member 2, of the jetty portions 5 at regular intervals. When the base end portions 3*b* of the respective pin terminals 3 are fitted into these fitting portions 10, the respective pin terminals 3 are arranged parallel to each other. Here, the mounting hole portions 9 and the fitting portions 10 are positioned so as to face each other, respectively. Furthermore, as shown in FIGS. 2 and 5, a plurality of exposure hole portions 6 and a plurality of positioning protrusions 2*e* are formed at the bottom plate portion 4 of the support member 2. The back sides of portions of the respective pin terminals 3 crossing the conductor exposure holes 23 of the flat cable 20, that is, the back sides of the joint portions 3*d* are exposed to the outside through the exposure hole portions 6. The positioning protrusions 2*e* are inserted into the through holes 24 formed at the end portion of the flat cable 20. When the joint portions 3*d* of the respective pin terminals 3 are connected to the connecting portions 21*a* of the belt-like conductors 21 of the flat cable 20 by, for example, spot welding as described below, electrodes of a spot welder are inserted into the exposure hole portions 6. Moreover, when the positioning protrusions 2*e* are inserted into the through holes 24 and are caulked, the end portion of the flat cable 20 are positioned on and fixed to the bottom plate portion 4 of the support member 2. Meanwhile, guide grooves 7 are formed on an inner bottom surface 4*a* of the support member 2. The guide grooves 7 make the respective pin terminals 3, which are fitted from the respective mounting hole portions 9, be arranged parallel to each other, and guide the respective pin terminals 3 so that the surfaces of the respective pin terminals 3 are exposed to the outside. Accordingly, by the formation of the guide grooves 7, it is possible to smoothly fit the respective pin terminals 3 to the support member 2 so that the respective pin terminals 3 are arranged parallel to each other. Therefore, it is possible to easily assemble the lead block 1. Meanwhile, if the guide grooves 7 are formed with dimensions where the respective pin terminals 3 can be press-fitted to the guide grooves, the guide grooves 7 function as holding portions that hold the respective pin terminals 3. Accordingly, it is possible to apply the guide grooves 7 instead of the fitting portions 10.

Figure 3:
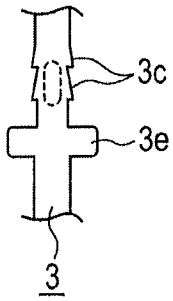
FIG. 3 is an enlarged view of a portion C of FIG. 2.

As shown in FIGS. 2 and 5, each of the pin terminals 3 includes a stopper portion 3*e* (locking portion) between the leading end portion 3*a* and the base end portion 3*b*. The stopper portion 3*e* is formed to be wider than the mounting hole portion 9. When each of the pin terminals 3 is fitted into the mounting hole portion 9 and the base end portion 3*b* is fitted to the fitting portion 10, the stopper portion 3*e* comes into contact with and is locked to the peripheral edge portion of the mounting hole portion 9, that is, an outer wall 2*g* of the jetty portion 5*a*. Accordingly, the stopper portion 3*e* has a function of determining the length of each of the pin terminals 3 that is fitted to the support member 2. Further, each of the pin terminals 3 includes wedge-shaped portions 3*c* (engaging portions) at a position corresponding to the mounting hole portion 9 in the state shown in FIG. 2, that is, near the base end portion of the stopper portion 3*e* (see FIG. 3). When each of the pin terminals 3 is fitted to the mounting hole portion 9 so that the stopper portion 3*e* comes into contact with the outer wall 2*g* (jetty portion 5) of the support member 2, the wedge-shaped portions 3*c* bite into the inner surface of the mounting hole portion 9. Accordingly, the wedge-shaped portions 3*c* have a function of tightly holding each of the pin terminals 3 at the support member 2 and can improve the mounting strength and mounting-position accuracy of each of the pin terminals 3 on the support member 2, so that it is possible to easily perform the work for manufacturing the lead block 1 without difficulty. Meanwhile, the stopper portion 3*e* may be formed in the shape of a wide flange so as to be locked to and come into contact with the peripheral edge portion of the mounting hole portion 2*b*, but may be formed in the shape of a protrusion. Further, since the stopper portions 3*e* are interposed between a holding wall portion 18*b* of the lower protruding portion 18*a* (lower cover 18) and the outer wall 2*g* of the support member 2 when the lead block 1 is received in a receiving recess 17*b* (receiving portion) of the lower connector holder 12*a*, the mounting strength of each of the pin terminals 3 on the rotary connector 30 is further increased. Details will be described below.

Meanwhile, a lead block (not shown), which is held by the movable-side housing 11, also has substantially the same basic structure as the basic structure of the lead block 1, and a required number of pin terminals are press-fitted and fixed to the support member.

Next, a procedure for connecting the flat cable 20 to the lead block 1 will be described. In order to connect one end portion of the flat cable 20 to the lead block 1, first, the end portion of the flat cable 20 is disposed on the inner surface portion 4*a* (bottom plate portion 4) of the support member 2 and the positioning protrusions 2*e* are inserted into the through holes 24. As a result, the end portion of the flat cable 20 is positioned relative to the support member 2 and the respective conductor exposure holes 23 are disposed directly above the respective exposure hole portions 6. The positioning protrusions 2*e* are thermally caulked in this state, so that the flat cable 20 is fixed while being positioned on the bottom plate portion 4 of the support member 2. After that, electrodes (not shown) of a spot welder are inserted into the exposure hole portion 6 and the conductor exposure hole 23, respectively. The joint portion 3*d* of the pin terminal 3 and the connecting portion 21*a* of the belt-like conductor 21 are made to come into press contact with each other and are joined to each other by spot welding that is performed by making current flow through the joint portion 3*d* and the connecting portion 21*a*. Meanwhile, a procedure for connecting the other end portion of the flat cable 20 to a lead block (not shown) is also the same as the above-mentioned procedure.

The lead block 1 is assembled with the lower connector holder 12*a* of the stationary-side housing 12 after being connected to the end portion (outer end portion) of the flat cable 20. A receiving recess 17*b*, in which the support member 2 can be disposed while being positioned, is formed at the lower protruding portion 17*a* of the lower connector holder 12*a* as shown in FIGS. 2 and 4. Further, the holding wall portion 18*b* is formed at the lower protruding portion 18*a* of the lower cover 18. The holding wall portion 18*b* extends along the lower surface of the support member 2, that is, the outer wall 2*g* of the jetty portion 5*a* positioned close to the leading end portions 3*a* of the pin terminals 3. A recessed portion 18*c* and a plurality of insertion holes 18*d* are formed at the holding wall portion 18*b*. The stopper portions 3*e* of the respective pin terminals 3 are disposed in the recessed portion 18*c*. Portions of the respective pin terminals 3, which are closer to the leading end portions than the stopper portions 3*e*, are individually inserted into the plurality of insertion holes 18*d*. Due to this structure, the stopper portions 3*e* of the respective pin terminals 3 are interposed between the holding wall portion 18*b* of the lower protruding portion 18*a* and the outer wall 2*g* of the support member 2. Accordingly, even though a large external force (a pushing force or a pulling force) is applied to the pin terminals 3 when an external connector is attached to and detached from the respective pin terminals 3 protruding outward from the insertion holes 18*d* of the holding wall portion 18*b*, there is no concern that the pin terminals 3 are separated from the support member 2 and there is also no concern that the separation of the welded portions between the joint portions 3*d* of the pin terminals 3 and the connecting portions 21*a* of the belt-like conductors 21 of the flat cable 20 causes conduction failure. Accordingly, it is possible to easily perform the work for attaching/detaching an external connector to/from the rotary connector 30 without difficulty. Meanwhile, since the recessed portion 18*c* of the holding wall portion 18*b* is formed with a depth where the stopper portions 3*e* come into contact with the outer wall 2*g* of the jetty portion 5*a*, the surface of the holding wall portion 18*b*, which faces the support member 2 and on which the recessed portion 18*c* is not formed, stably comes into contact with the outer wall 2*g* of the jetty portion 5*a*. Since the respective pin terminals 3 and the lead block 1 can be reliably mounted on the stationary-side housing 12 without rattling in this structure, this structure is highly preferable. Here, the recessed portion 18*c* may be formed on the outer wall 2*g* of the jetty portion 5*a*.

Next, a procedure for assembling the lead block 1, which is connected to the end portion (outer end portion) of the flat cable 20, with the lower connector holder 12*a* of the stationary-side housing 12 will be described. In order to form the lead block 1 connected to the flat cable 20, first, the support member 2 is disposed and positioned in the receiving recess 17*b* (receiving portion) of the lower protruding portion 17*a* of the outer cylindrical portion 17. Then, the lower cover 18 is assembled with the outer cylindrical portion 17 so that the leading end portions 3*a* of the respective pin terminals 3 are inserted into the respective insertion holes 18*d* of the holding wall portion 18*b* of the lower protruding portion 18*a* (lower cover 18). The work for assembling the lead block 1 is performed when the outer cylindrical portion 17 of the stationary-side housing 12 and the lower cover 18 are integrated with each other by snap fitting. That is, the support member 2 is disposed in the receiving recess 17*b* while being positioned. Then, the lower cover 18 is assembled with the outer cylindrical portion 17 so that the leading end portions of the respective pin terminals 3 are inserted into the respective insertion holes 18*d* of the holding wall portion 18*b* of the lower protruding portion 18*a*. While the lower connector holder 12*a* is assembled by the lower protruding portion 17*a* and the lower protruding portion 18*a*, the lead block 1 is assembled with the lower connector holder 12*a*.

Since an insulating support member 2, which is molded by a simple mold, can be applied to the lead block 1 of this embodiment as described above, insert molding does not need to be performed using a mold having the complicated structure. Further, since it is possible to manufacture the lead block 1 by fitting the plurality of pin terminals 3 into the support member 2 and holding the plurality of pin terminals on the support member, it is possible to significantly reduce the manufacturing costs of the lead block and to significantly reduce the manufacturing costs of the rotary connector. Moreover, since these lead blocks 1 can use the common support member 2, the lead block 1 can also be applied to the structure that has different number of pin terminals. For this reason, since it is possible to further reduce component costs, a rotary connector 30 very advantageous for cost reduction is obtained.

Further, when the lead block 1 connected to the flat cable 20 is assembled with the lower connector holder 12*a* of the stationary-side housing 12 in this embodiment, the support member 2 is held in the receiving recess 17*b* of the lower protruding portion 17*a* while being positioned and the stopper portions 3*e* of the respective pin terminals 3 are interposed between the holding wall portion 18*b* of the lower protruding portion 18*a* and the outer wall 2*g* of the support member 2. For this reason, even though a large external force (a pushing force or a pulling force) is applied to the pin terminals 3 when an external connector is attached to and detached from the respective pin terminals 3 protruding outward from the insertion holes 18*d* of the holding wall portion 18*b*, there is no concern that the pin terminals 3 are separated from the support member 2 and there is also no concern that the separation of the welded portions between the joint portions 3*d* of the pin terminals 3 and the connecting portions 21*a* of the belt-like conductors 21 of the flat cable 20 causes conduction failure. Accordingly, it is possible to easily perform the work for attaching/detaching an external connector to/from the rotary connector 30 at ease.

Meanwhile, in this embodiment, for example, pin terminals of a lead block (not shown) connected to the other end portion of the flat cable 20, that is, a lead block assembled with the upper connector holder 11*a* of the movable-side housing 11 are formed in a substantially L shape. For this reason, even though the stopper portions of the respective pin terminals are not interposed between this lead block and at a part of the movable-side housing 11, there is no concern that the pin terminals cause positional deviation relative to the support member when an external connector is attached to and detached from the pin terminals. However, if the pin terminals of this lead block (not shown) have a straight shape, it is preferable that the stopper portions of the respective pin terminals be interposed by using a part (for example, the upper rotor 15) of the movable-side housing 11 like in the above-mentioned lead block 1.

Moreover, in this embodiment, mounting hole portions 9 into which the wedge-shaped portions 3*c* of the plurality of pin terminals 3 are fitted are formed at the support member 2 of the lead block 1 connected to one end portion of the flat cable 20, and fitting portions 2*c* as holding portions, where the base end portions 3*b* of the respective pin terminals 3 are press-fitted and held so that the respective pin terminals 3 are arranged parallel to each other, are formed at the support member 2 of the lead block 1. For this reason, the mounting strength and mounting-position accuracy of the pin terminals 3 on the support member 2 are improved. Meanwhile, the mounting hole portions 9 and the fitting portions 2*c* have been formed as holding portions in this embodiment, but the guide grooves 7 may also be applied as holding portions. Accordingly, both the fitting portions 2*c* and the guide grooves 7 may be used as holding portions, and holding portions may be formed of only the guide grooves 7.

Further, if the lower cover 18 (first case body) and the outer cylindrical portion 17 (second case body) are connected to each other by snap fitting while the support member 2 is positioned in this embodiment, it is possible to easily perform the work for assembling the lead block 1 with the lower cover 18 and the outer cylindrical portion 17.

Meanwhile, as described above, a lead block (not shown) connected to the other end portion of the flat cable 20 also has substantially the same basic structure as the basic structure of the above-mentioned lead block 1. Accordingly, even in this lead block (not shown), the mounting strength and mounting-position accuracy of the pin terminals on the support member are easily improved, working efficiency is good when the flat cable 20 is connected, and conduction reliability is also high after the flat cable 20 is connected.

It should be understood by those skilled in the art that various modifications, combinations, sub-combinations and alterations may occur depending on design requirements and other factors insofar as they are within the scope of the appended claims of the equivalents thereof.

What is claimed is:

1. A rotary connector comprising:

a movable-side housing and a stationary-side housing connected so as to be rotatable relative to each other;

an annular space formed between the movable-side housing and the stationary-side housing;

a flat cable received in the annular space while being wound and comprising a plurality of belt-like conductors, the belt-like conductors being arranged parallel to each other and covered by a pair of insulating films except for connecting portions; and a lead block connected to the connecting portions of the flat cable and including a plurality of pin terminals arranged parallel to each other, the lead block electrically connected to an outside of the rotary connector, wherein the flat cable and the lead block overlap each other so that the plurality of pin terminals cross the plurality of belt-like conductors, and the plurality of pin terminals of the lead block fitted to and held by an insulating support member so that leading end portions of the plurality of pin terminals protrude to the outside of the rotary connector, and include joint portions connected to the connecting portions of the flat cable.

2. The rotary connector according to claim 1, wherein the plurality of pin terminals include locking portions that are locked to an outer wall of the support member while being fitted to and held by the support member, at least one of the movable-side housing and the stationary-side housing includes a receiving portion in which the lead block is received, and includes a holding wall portion including insertion holes to which the leading end portions of the plurality of pin terminals are inserted, and the locking portions are interposed between the holding wall portion and the support member while the lead block is received.

3. The rotary connector according to claim 2, wherein the stationary-side housing is formed by snap fitting a first case body to a second case body, the receiving portion is formed at the second case body, the insertion holes are formed at the first case body, and the first and second case bodies form a connector holder that holds the lead block.

4. The rotary connector according to claim 1, wherein the support member includes:

a first holding portion formed close to the leading end portions of the plurality of pin terminals and where the plurality of pin terminals are fitted and held, and a second holding portion formed close to base end portions of the plurality of pin terminals and holding the plurality of pin terminals so that the plurality of pin terminals are arranged parallel to each other.

5. The rotary connector according to claim 4, wherein the support member includes:

exposure hole portions that are formed so that the joint portions are disposed between the first and second holding portions, and guide grooves that guide the plurality of pin terminals so that the plurality of pin terminals are inserted while surfaces of the pin terminals are exposed from the support member, when the plurality of pin terminals are inserted from the first holding portion toward the second holding portion, and the plurality of pin terminals include engaging portions that are formed so as to bite into inner surfaces of the first holding portion.

6. The rotary connector according to claim 1, wherein the connecting portions of the flat cable, which are connected to the joint portions of the plurality of pin terminals, are exposed from a plurality of hole portions that are formed at the pair of insulating films.

* * * * *